US007483042B1

(12) United States Patent
Glen

(10) Patent No.: US 7,483,042 B1
(45) Date of Patent: Jan. 27, 2009

(54) VIDEO GRAPHICS MODULE CAPABLE OF BLENDING MULTIPLE IMAGE LAYERS

(75) Inventor: David I. J. Glen, Toronto (CA)

(73) Assignee: ATI International, SRL, West Indies (BB)

( * ) Notice: Subject to any disclaimer, the term of this patent is extended or adjusted under 35 U.S.C. 154(b) by 0 days.

(21) Appl. No.: 09/484,123

(22) Filed: Jan. 13, 2000

(51) Int. Cl.
*G09G 5/10* (2006.01)

(52) U.S. Cl. ..... 345/629; 345/538; 345/419; 345/506; 382/284

(58) Field of Classification Search ..... 382/303, 382/302, 284; 345/629, 790, 592, 538, 419, 345/506; 430/14, 13
See application file for complete search history.

(56) References Cited

U.S. PATENT DOCUMENTS 5,065,143 A 11/1991 Greaves et al.
5,119,177 A 6/1992 Lim
5,307,156 A 4/1994 Yamamoto et al.
5,367,318 A 11/1994 Beaudin et al.
5,428,385 A 6/1995 Sakata
5,440,682 A * 8/1995 Deering ..... 345/503
5,475,442 A 12/1995 Matsushita
5,521,722 A 5/1996 Colvill et al.
5,537,157 A 7/1996 Washino et al.
5,598,525 A 1/1997 Nally et al.
5,621,869 A * 4/1997 Drews ..... 345/634
5,663,768 A 9/1997 Yang
5,668,890 A 9/1997 Winkelman
5,790,096 A 8/1998 Hill, Jr.
5,801,716 A * 9/1998 Silverbrook ..... 345/506
5,841,439 A * 11/1998 Pose et al. ..... 345/418
5,861,864 A 1/1999 Jensen
5,874,937 A 2/1999 Kesatoshi
5,874,967 A 2/1999 West et al.
5,900,860 A 5/1999 Ueda
5,907,364 A 5/1999 Furuhata et al.
5,963,201 A 10/1999 McGreggor et al.
5,982,443 A 11/1999 Chung
6,028,583 A 2/2000 Hamburg
6,034,667 A 3/2000 Barrett
6,064,393 A * 5/2000 Lengyel et al. ..... 345/427

(Continued)

OTHER PUBLICATIONS

Foley, Computer Graphiocs: Principles and Practice, 1987, Addison-Wesley, Second edition, pp. 835.*

(Continued)

*Primary Examiner*—Kee M Tung
*Assistant Examiner*—J. Amini
(74) *Attorney, Agent, or Firm*—Vedder Price P.C.

(57) ABSTRACT

A video graphics module capable of blending multiple image layers includes a plurality of video graphic pipelines, each of which is operable to process a corresponding image layer. One of the video graphic pipelines processes a foremost image layer. For example, the foremost image layer may be a hardware cursor. The video graphics module also includes a blending module that is operably coupled to the plurality of video graphic pipelines. The blending module blends, in accordance with a blending convention (e.g., AND/Exclusive OR blending and/or alpha blending), the corresponding image layers of each pipeline in a predetermined blending order to produce an output image. The blending module blends the foremost image layer such that it appears in a foremost position with respect to the other image layers.

27 Claims, 4 Drawing Sheets

U.S. PATENT DOCUMENTS

| | | | | |
|---|---|---|---|---|
| 6,069,664 | A | 5/2000 | Zhu et al. | |
| 6,081,254 | A | 6/2000 | Tanaka et al. | |
| 6,088,038 | A | 7/2000 | Edge et al. | |
| 6,091,857 | A * | 7/2000 | Shaw et al. | 382/251 |
| 6,157,415 | A | 12/2000 | Glen | |
| 6,184,891 | B1 * | 2/2001 | Blinn | 345/426 |
| 6,288,730 | B1 * | 9/2001 | Duluk et al. | 345/552 |
| 6,326,964 | B1 * | 12/2001 | Snyder et al. | 345/419 |
| 6,462,786 | B1 * | 10/2002 | Glen et al. | 348/599 |
| 6,473,091 | B1 * | 10/2002 | Iida et al. | 345/589 |
| 6,501,480 | B1 * | 12/2002 | MacInnis et al. | 345/538 |
| 6,538,656 | B1 * | 3/2003 | Cheung et al. | 345/519 |
| 6,717,576 | B1 * | 4/2004 | Duluk et al. | 345/419 |
| 6,768,774 | B1 * | 7/2004 | MacInnis et al. | 375/240.15 |
| 6,927,783 | B1 * | 8/2005 | MacInnis et al. | 345/629 |
| 2005/0024369 | A1 * | 2/2005 | Xie | 345/547 |

OTHER PUBLICATIONS

Hanspeter Pfister, Jan Hardenbergh, Jim Knittel, Hugh Lauer, Larry Seiler; The VolumePro real-time ray-casting system; Proceedings of the 26th annual conference on Computer graphics and interactive techniques SIGGRAPH '99, Jul. 1999.*

* cited by examiner

VIDEO GRAPHICS MODULE CAPABLE OF BLENDING MULTIPLE IMAGE LAYERS

TECHNICAL FIELD OF THE INVENTION

This invention relates generally to video graphic processing and more particularly to blending multiple image layers.

BACKGROUND OF THE INVENTION

Computers are known to include a central processing unit, system memory, interconnecting buses, audio processing circuitry, video graphics processing circuitry, and peripheral ports. The peripheral ports allow the central processing unit to communicate with external peripheral devices such as monitors, printers, external tape drives, etc. If the computer system includes basic video graphic processing, the video graphics processing circuitry receives graphics data from the central processing unit and prepares it for display on the monitor. Such graphics data is generated by the central processing unit while performing an application such as word processing, desktop operation, drawing application, presentation application, spreadsheet application, etc. In many computer systems, a cursor is provided that allows the user to utilize a graphical interface to select certain objects of an application.

Currently, the cursor may be generated in hardware as a monochrome cursor or as a color cursor using AND/XOR blending. Alternatively, the cursor may be generated in software using any desired color depth or blending format. In particular, software generated color cursors using alpha blending are becoming more common and will be used more in future operating systems. For a hardware generated monochrome cursor, data is stored as 2 bits per pixel (bpp) in a frame buffer of the video graphics circuitry. As is known, the frame buffer stores video graphics data that will subsequently be displayed. The 2 bpp are representative of four codes, where "00" indicates that the cursor is to be cursor color "0", which addresses a programmable register to retrieve the cursor color, which is normally set to black. A code of "01" indicates that the cursor is to be cursor color "1", which addresses a second programmable register to retrieve the color, which is normally set to white. A code of "10" indicates that the cursor is to be transparent. A code of "11" indicates that the cursor is transparent with the background color inverted. As the cursor data is retrieved from the frame buffer, it is mixed, via a multiplexing function, with other video graphics data stored in the frame buffer to produce a composite image. Such a hardware implementation does not allow the monochrome cursor to be alpha blended with other video graphics data.

Current hardware generated color cursors are AND/XOR blended with other video graphics data on a pixel by pixel basis. AND/XOR blending begins by ANDing each bit of video graphics data with an ANDing bit. The resultant of each ANDing function is then exclusively ORed with a corresponding bit of the color cursor data to produce the blended data. Note that the color depth of the video graphics data and the color cursor data may be 8, 16, 24 bpp, etc. While this approach allows a color cursor to be blended with video graphics data, it does not allow alpha blending of the color cursor data with the video graphics data.

Software generation of a color cursor allows the cursor data to be alpha blended with underlying video graphics data to produce a composite image, which is stored in the frame buffer. As such, the software cursor is merged into the graphics layer. Such software alpha blending of a color cursor works well as long as the composite image is not further blended with video data (e.g., a digitized television signal). When the composite image is to be blended with video data, if the video layer is on top of the graphics layer, the cursor will be blocked. Further, if the cursor is blended with a key color (i.e., data that indicates placement of video in the display), the key color is altered, thus video data will not appear in the desired area of the display. Note that alpha blending may be performed on a pixel-by-pixel basis using a pre-multiplied, or associated, alpha blend equation of P=(1-alpha)*graphics data (R,G,B)+cursor data (R, G, B,) or an non-premultiplied alpha equation of P=(1-alpha)*graphics data+alpha*cursor data, where P equals the result pixel data, and where alpha is based on opacity.

Therefore, a need exists for a video graphics module that is backwards compatible with existing cursor implementations and is also capable of alpha blending multiple image layers wherein at least one of the image layers includes video data without the limitations of monochrome cursors, hardware color cursors using AND/XOR blending, and software color cursors.

DETAILED DESCRIPTION OF A PREFERRED EMBODIMENT

Generally, the present invention provides a video graphics module capable of blending multiple image layers. Such a video graphics module includes a plurality of video graphic pipelines, each of which is operable to process a corresponding image layer. One of the video graphic pipelines processes a foremost image layer. For example, the foremost image layer may be a hardware cursor. The video graphics module also includes a blending module that is operably coupled to the plurality of video graphic pipelines. The blending module blends, in accordance with a blending convention (e.g., AND/Exclusive OR blending and/or alpha blending), the corresponding image layers of each pipeline in a predetermined blending order to produce an output image. The blending module blends the foremost image layer such that it appears in a foremost position with respect to the other image layers. With such a video graphics module, a cursor may be alpha blended with graphics data and/or video data without loss of video data and without loss of the cursor.

Figure 1:
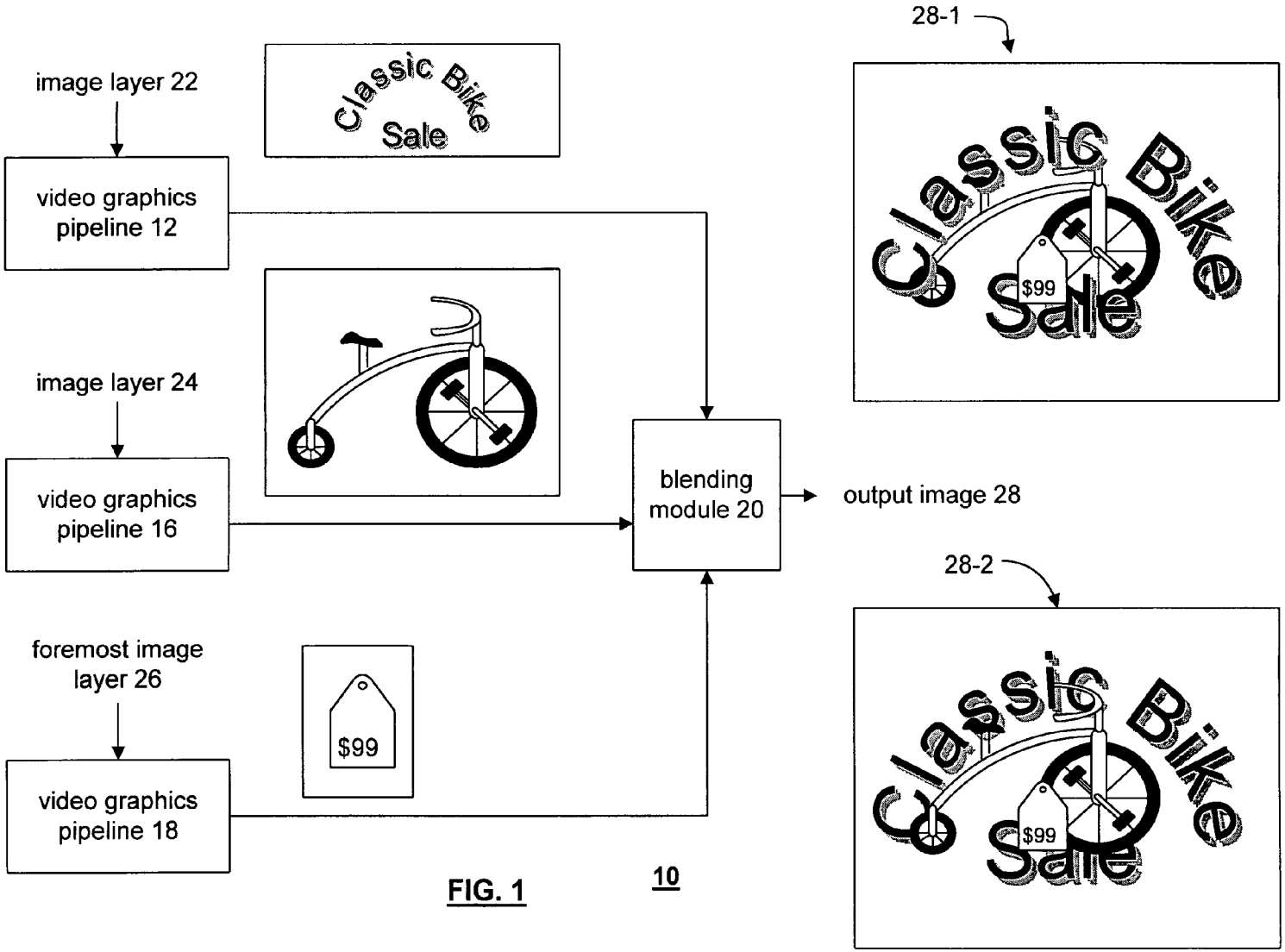
FIG. 1 illustrates a schematic block diagram of a video graphics module in accordance with the present invention.

The present invention can be more fully described with reference to FIGS. 1-5. FIG. 1 illustrates a schematic block diagram of a video graphics module 10 that includes a plurality of video graphic pipelines 12-18 and a blending module 20. The construct of the video graphics pipelines 12-18 is dependent on the type of data being represented by the corresponding image layers. For example, if image layer 22 is graphics data received from a central processing unit, the video graphics pipeline corresponds to a video graphics processor that receives the graphical information and produces the corresponding pixel information. Such a video graphics pipeline is found in ATI Technologies, Inc. All in Wonder Board and newer versions thereof. If the image layer is representative of video data, for example image layer 24, the corresponding video graphics pipeline 16 may include a video decoder, video capture module, a YUV-to-RGB conversion module, and/or a scaler. The video decoder and video capture module are of a construct as found in the ATI Technologies, Inc. All in Wonder Board and versions thereof. In addition, the image layer may be a hardware cursor. For example, the foremost image layer 26 may be a hardware cursor. As such, the video graphics pipeline 18 would be a hardware cursor pipeline as found in existing video graphic circuitry.

FIG. 1 further illustrates a graphical representation of the functionality of blending module 20. As shown, the video graphics pipeline 12 outputs text information (e.g., classic bike sale). The second video graphic pipeline 16 outputs an image of a bicycle. Such an image of the bicycle may be a still frame, or a video of a bicycle in motion. The third video graphics pipeline 18 outputs a tag having a sales price thereon. The blending module receives the corresponding pixel information for each of these images and blends them to produce an output image 28. The blending module 20 blends these images in accordance with a blending convention, such as AND/Exclusive OR blending and/or an alpha blending equation. The blending module 20 also blends the image layers in a predetermined order such that the output image 28 has the foremost image layer 26 in a foreground position with respect to the other image layers. As such, the blending module 20 may blend the classic bike sale text with the image of the bicycle to have the classic bike sale text in a foreground position with the bicycle as shown in output image 28-1, or have the bicycle in a foreground position with respect to the text, as shown in output image 28-2. Further, but not shown, the classic bike sale text and the image of the bicycle may be alpha blended together with the tag superimposed thereon.

If the blending module 20 is performing alpha blending, the blending module will use the premultiplied alpha blending equation or the non-premultiplied alpha blending equation. The alpha blending value may be a specific per pixel alpha value or a global alpha value and is done using one of a plurality of pixel depth. For example, the pixel depth may be 2, 8, 16, 24, or 32 bits per pixel. The AND/Exclusive OR blending may be done with any of these pixel depths.

As one of average skill in the art will appreciate, the video graphics module 10 allows multiple image layers to be blended in a predetermined order using a blending convention to maintain a foremost image without loss of data of other image layers. This is particularly useful when a hardware cursor is to be alpha blended with other image layers. One of average skill in the art will further appreciate that the video graphics module 10 is backward compatible to process monochrome cursors, hardware or software color cursors.

Figure 2:
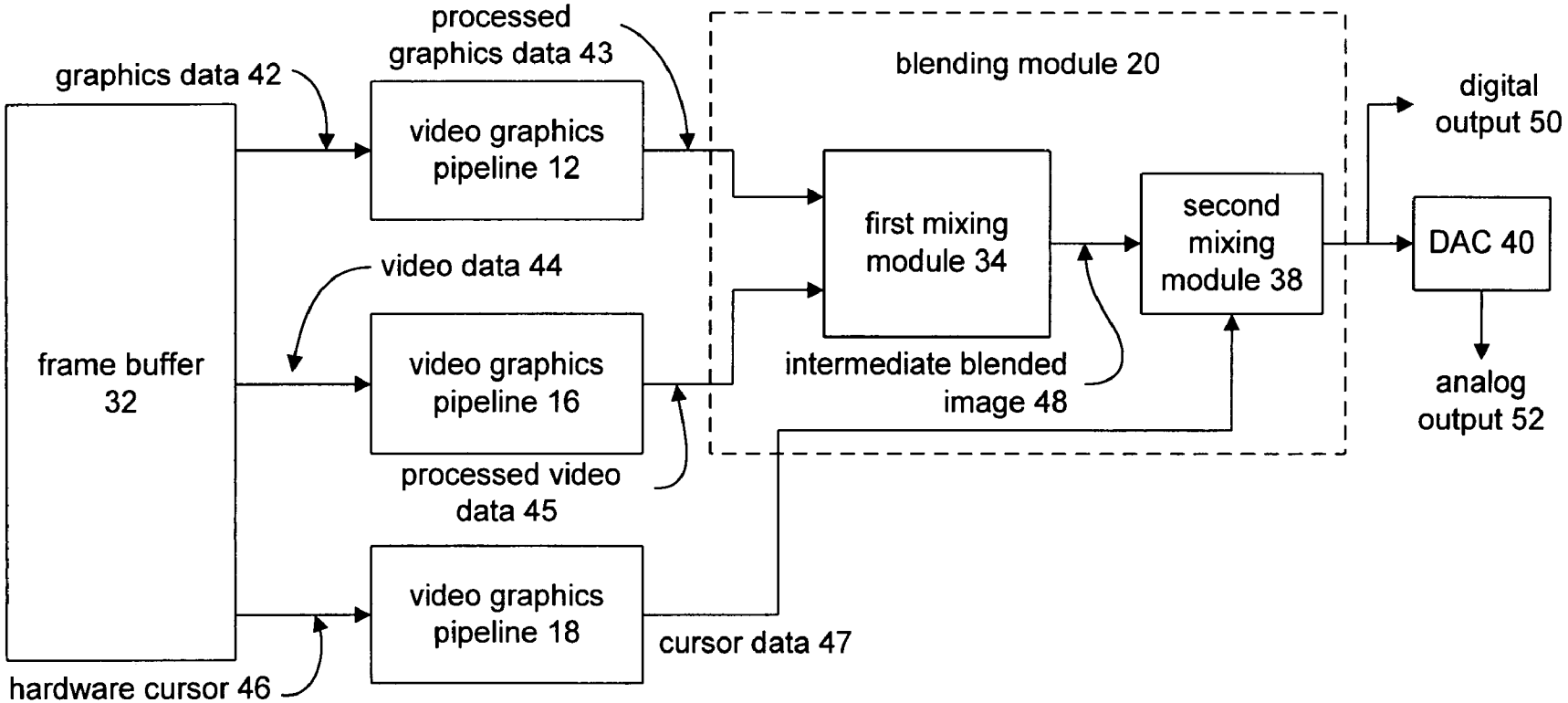
FIG. 2 illustrates a schematic block diagram of another embodiment of a video graphics module in accordance with the present invention.

FIG. 2 illustrates a schematic block diagram of another embodiment of the video graphics module 30. The video graphics module 30 includes a frame buffer 32, the plurality of video graphic pipelines 12-18, the blending module 20, and a digital-to-analog converter 40. The blending module 20 includes a first mixing module 34 and a second mixing module 38. As shown, the first video graphics pipeline 12 retrieves graphics data 42 from the frame buffer and provides processed graphics data 43 to the blending module 20. The second video graphics pipeline 16 retrieves video data 44 from the frame buffer 32 to provide processed video data 45 to the blending module 20. The third video graphics pipeline 18 retrieves hardware cursor data 46 from the frame buffer 32 and provides cursor data 47 to the blending module 20. Note that the graphics data, 42, the video data 44, and the hardware cursor 46 correspond to image layers that may have an RGB color base or a YUV color base. For an RGB color base, the video graphic pipelines 12-18 process the data in an RGB color base format. For a YUV color base, the video graphic pipelines 12-18 process the image layers in a YUV color base format.

The first mixing module 34 is operably coupled to receive the processed graphics data 43 from the video graphics pipeline 12 and the processed video data 45 from the video graphics pipeline 16. The first mixing module 34 mixes the signals to produce an intermediate blended image 48. In this configuration, the intermediate blended image 48 includes the processed video data 45 blended with the processed graphics data 43. As mentioned in the background section, the video data 44 is retrieved from a video capture module based on color key information contained with the graphics data, which is often referred to as keying. Note that the keying process may be performed using the graphics data 42 and/or the video data 44. Further note that the keying may be performed at the end of pipelines 12 and/or 16 or at the beginning of the mixing module 34. Alternatively, the video data may be received directly from a video decoder based on the color key information without storage in the video capture module. By performing the mixing function on the processed video data 45 and the processed graphics data 43 prior to blending in the cursor data 47, the subsequent mixing of the hardware cursor will preserve the cursor data and the video data.

The second mixing module 38 receives the intermediate blended image 48 and the cursor data 47 from the third graphics pipeline 18. The second mixing module 38 mixes these images to produce a digital output 50. The mixing performed by the first and second mixing modules may be done utilizing the blending convention (i.e., the AND/Exclusive OR blending or alpha blending), wherein the data will be one of a plurality of pixel depths. The digital output 50 may be provided to an LCD panel, or other digital display module, or provided to the digital to analog converter 40. The digital to analog converter 40 converts to the digital output 50 into an analog output 52 that may be provided to an analog display, such as a CRT.

Figure 3:
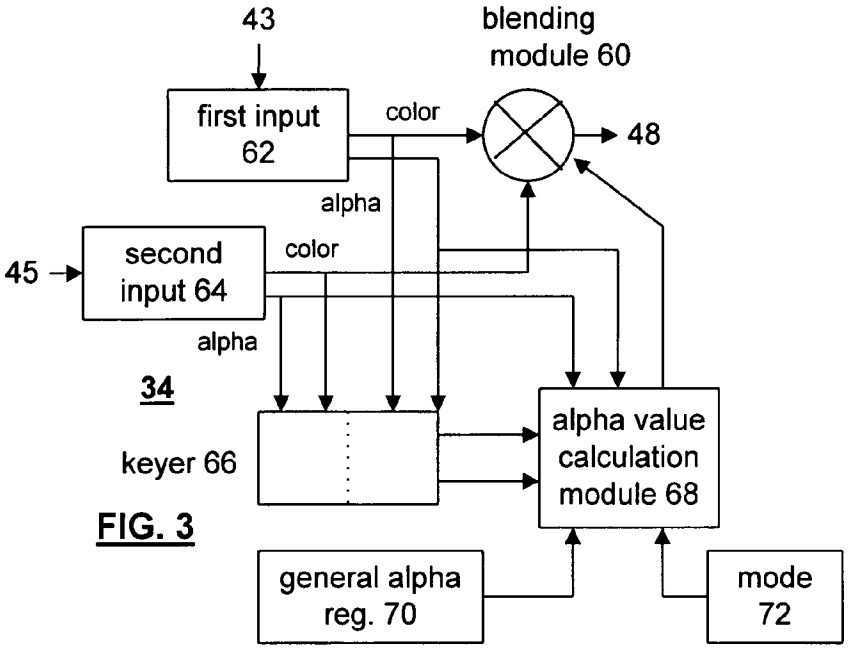
FIG. 3 illustrates a schematic block diagram of a mixing module of the video graphics module of FIG. 2.

FIG. 3 illustrates a schematic block diagram of the first mixing module 34. Note that the elements of the first mixing module 34 may be implemented as discrete processing modules and associated memories or via a single processing module and associated memory. The processing module may be a single processing device or a plurality of processing devices. Such a processing device may be a microprocessor, microcomputer, digital signal processor, central processing unit of a computer or work station, digital circuitry, state machine, and/or any device that manipulates signals (e.g., analog and/or digital) based on operational instructions. The memory may be a single memory device or a plurality of memory devices. Such a memory device may be a random access memory, read-only memory, floppy disk memory, hard drive memory, extended memory, magnetic tape memory, zip drive memory and/or any device that stores digital information. Note that when the processing module implements one or more of its functions, via a state machine or logic circuitry, the memory storing the corresponding operational instructions is embedded within the circuitry comprising the state machine or logic circuitry.

The first mixing module 34 includes a first input 62, a second input 64, a blending module 60, a keyer 66, an alpha value calculation module 68, at least one general alpha value register 70 and a mode module 72. As configured, the first mixing module 34 may be in one of three alpha blending modes or an AND/XOR mixing mode. The first alpha blending mode involves a per pixel determination of the alpha blending data. The second alpha blending mode has involves alpha blending based on a global alpha blending value. The third alpha blending mode involves a keyed alpha blending value. The AND/XOR mixing mode has the blending module 60 mixing the color data using an AND/XOR function. Note that selection of any one of these modes may be done via a graphical user interface, a programmed decision of a particular application, or selected within features of the operating system.

For the AND/XOR mode, the first and second inputs 62 and 64, which may be buffers or terminal nodes, receive color data 43 and 45 from the respective pipelines and provide the color data to the blending module 60. The blending module 60, based on an input from the alpha value calculation module 68, performs and AND/XOR function upon the color data 43 and 45 to produce the intermediate blended image 48.

When the alpha blending mode 72 indicates using a global alpha blending value, the inputs 62 and 64 receive the processed graphics data 43 and the video data 45, which are provided to the blending module 60. The alpha value calculation module 68 retrieves at least one global alpha blending value from the general alpha register 70 and provides it to the blending module 60. The particular global alpha blending value retrieved will depend on the desired alpha blending affect and on which layers will be affected. For example, a value of alpha A may be retrieved for both the graphics layer and the video layer, such that the same alpha blending is performed on both layers. As an additional example, a value of alpha B may be retrieved for the graphics layer and a value of alpha C may be retrieved for the video layer, such that the alpha blending affect on each layer is independent. The blending module 60 alpha blends, using the global alpha blending value, the graphics data 43 and the video data 45 to produce the intermediate blended image 48.

When the alpha blending mode 72 indicates using a per pixel alpha blending value, the inputs 62 and 64 receive the processed graphics data 43 and the video data 45, which are provided to the blending module 60. The first and second inputs 62 and 64 also receive the corresponding per pixel alpha blending value, which may be the same for the video layer and the graphics layer, or independent per pixel values. The per pixel alpha blending value(s) is provided to the alpha value calculation module 68, which provides it to the blending module 60. The blending module 60 alpha blends the graphics data 43 and the video data 45, on a per pixel basis using the per pixel alpha blending value, to produce the intermediate blended image 48. Note that the blending module 60 may be programmed to perform either a premultiplied alpha blending function or a non-premultiplied alpha blending function, which ever is correct for the current video or graphics input data.

When the alpha blending mode 72 indicates using a key alpha blending value, the inputs 62 and 64 receive the processed graphics data 43 and the video data 45, which are provided to the blending module 60. Optionally, the inputs 62 and 64 may also receive a corresponding per pixel alpha value. The processed graphics data 43, the processed video data 45, and the per pixel alpha value are provided to the keyer 66, which interprets the inputs to provide an alpha key indicator to the alpha calculation module 68. The alpha key indication, the alpha blending mode 72, and the global alpha value in register 70 are interpreted by the alpha calculation module 68 to determine a type of alpha blending. For example, alpha blend at 50%, fade in, fade out, etc. The alpha calculation module 68 retrieves the particular type of alpha blending from the mode module 72 and provides the corresponding alpha blending value(s) to the blending module 60. The blending module 60 alpha blends the graphics data 43 and the video data 45, on a per pixel basis using the corresponding per pixel alpha blending value(s), to produce the intermediate blended image 48. Note that the graphics and video keys are mixed by the keyer 66 in a manner that is known in the art to produce a one-bit result per pixel. For example, 0 is for graphics and 1 for video. The alpha value calculation module 68 utilizes the one-bit result to "turn-on" a black circuit for one input layer (e.g., the video layer) and select a global alpha value for the other layer (e.g., the graphics layer). Further note that alpha blending without blackening out the key color is not useful, as it would change the color of the selected layer. The mixing module 34 of FIG. 3, however, allows fading in/out without changing the color.

The alpha value calculation module 68 may further produce a control signal that causes one of the inputs of the blending module 60 to be received as a black signal. With one input blacked out, the other input may be phased in using a varying alpha value, as derived by the alpha value calculation module 68. Note that the varying alpha value is stored in the alpha register 70. Alternatively, the alpha value calculation module 68 may generate a black signal that is gated with one of the inputs to the blending module 60 to achieve the blacking of one of the inputs. In this alternative, the alpha value calculation module 68 still generates the varying alpha value for the phase-in/phase-out effect.

The first mixing module 34 may further include a pair of multiplexors wherein the output of the multiplexors are operably coupled to the first and second inputs, respectively. As such, each multiplexor is operably coupled to receive a plurality of image input layers and selects one of them for blending. The selection of one of the image input layers by each of the multiplexor is controlled by the alpha calculation module 68 to produce the desired blended image. Note that the multiplexors may be included in the first and second input modules 62 and 64.

Figure 4:
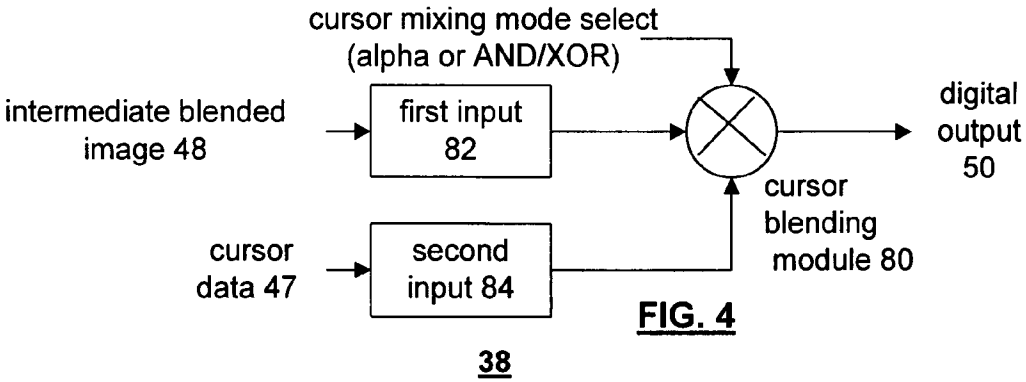
FIG. 4 illustrates a schematic block diagram of another mixing module of the video graphics module of FIG. 2.

FIG. 4 illustrates a schematic block diagram of the second mixing module 38. In this embodiment, the second mixing module 38 includes a first input 82, a second input module 84 and an cursor blending module 80. The first input module 82 is operably coupled to receive the intermediate blended image 48 and the second input module 84 is operably coupled to receive the cursor data 47. The first and second inputs are operably coupled to the cursor blending module 80 that blends the intermediate blended image 48 with the cursor data 47 to produce the digital output 50. The second input module 84 may include a pixel color depth conversion module to convert the pixel color depth of the hardware cursor data between M bits and N bits. For example, the pixel conversion may be between 2 bits to 8 bits, 8 to 16, 16 to 24, or to 32, or any combination thereof. Note that the pixel color depth conversion module would be utilized to match the hardware cursor pixel depth with the pixel depth of the intermediate blended image 48. Further note that the cursor blending module 80 may receive cursor mixing mode selection information which indicates the type of mixing to be performed. For example, the cursor mixing selection may be to use AND/XOR mixing, to use premultiplied alpha blending, or to use non-premultiplied alpha blending. Still further note that the cursor mixing mode select information may be received in conjunction with the cursor data 47.

Figure 5:
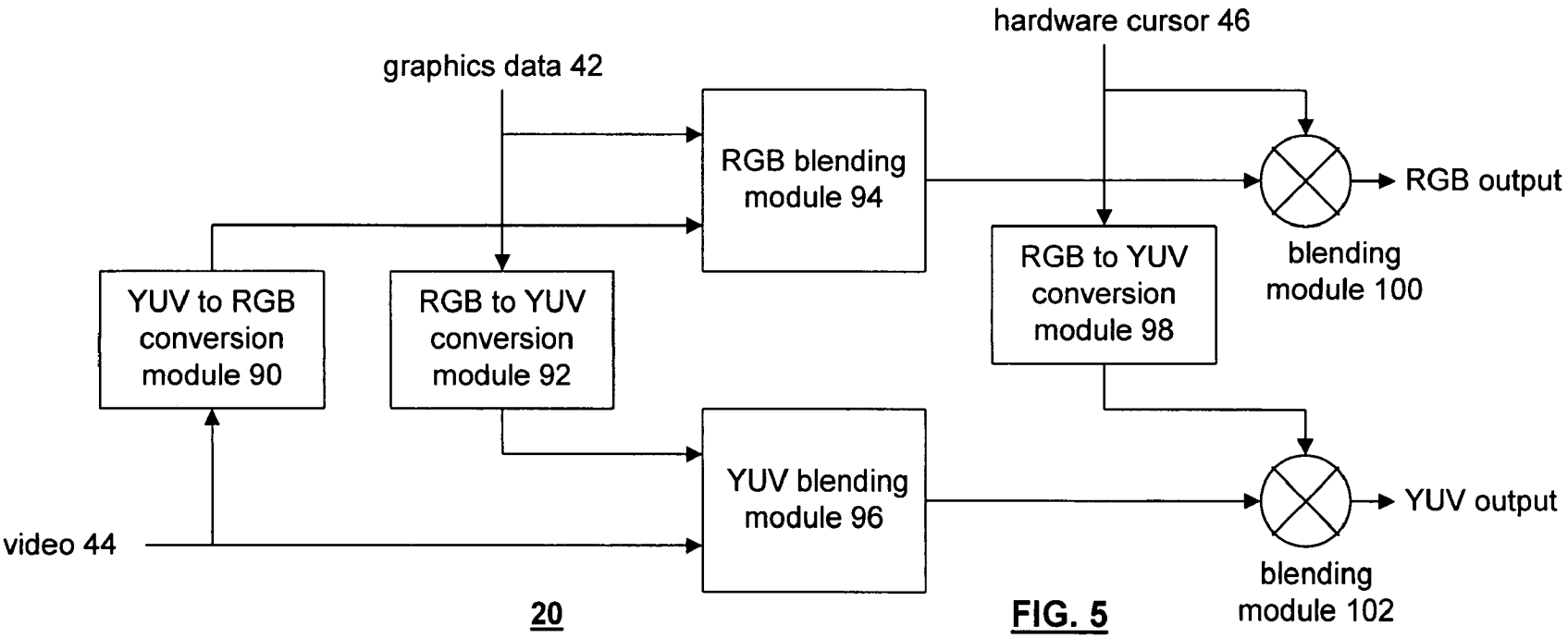
FIG. 5 illustrates a schematic block diagram of another embodiment of a video graphics module in accordance with the present invention.

FIG. 5 illustrates a schematic block diagram of another embodiment of the blending module 20. In this embodiment of the blending module 20, the resultant output images have an RGB color or a YUV color base. To achieve the multiple color base outputs, the blending module includes RGB to YUV conversion modules 90, 92 and 98. The blending module also includes an RGB blending module 94 and a YUV blending module 96. The RGB blending module 94 and YUV blending module 96 corresponds to the first mixing module 34 of FIG. 2 and FIG. 3 and includes similar functionality, but operate in the RGB color base for module 94 and the YUV color base for module 96.

As such, graphics data 42 received in an RGB color base is converted to a YUV color base via module 92 and video received in an YUV color base is converted to an RGB color base by module 90. The RGB color base graphics data 42 and the converted video data 44 are mixed by the RGB blending module 94 to produce an intermediate blended image. The blending module 100 receives the intermediate blended image and the hardware cursor data 46 to produce the RGB output image.

The video data 44 and the converted graphics data are mixed by the YUV blending module 96 to produce a YUV intermediate blended image. This blended image is mixed with a YUV converted representation of the hardware cursor data 46 to produce a YUV output image. The YUV output image is produced by blending module 102. As such, YUV inputs to YUV outputs do not need to be converted into RGB and back to YUV, which, if required to occur, would causes quality loses.

The preceding discussion has presented multiple embodiments of a video graphics module that performs blending on multiple images without loss of underlying video data and preserving a foremost image. The video graphics module is particularly useful when alpha blending, or shadowing, a hardware cursor and the underlying video graphics data includes video data. As in previous implementations, if such were to be performed, the video data would be lost underneath the hardware cursor and shadow area. With the video graphics module of the present invention, the underlying video data is not lost, since it is blending with graphics data prior to blending with the cursor, thereby producing the desired alpha blending results. As one of average skill in the art will appreciate, other embodiments may be derived from the teachings of the present invention without deviating from the scope of the claims.

What is claimed is:

1. A video graphics module comprises:

a plurality of video graphics pipelines, wherein each of the plurality of video graphics pipelines is operable to process a corresponding image layer and wherein one of the plurality of video graphics pipelines processes a foremost graphics image layer and the video graphics pipelines is operable to process the corresponding image layers in parallel, wherein each of the foremost graphics image layer and the corresponding image layers are operatively received from at least one frame buffer; and a blending module operably coupled to the plurality of video graphics pipelines, wherein the blending module is operable to blend the corresponding image layers in a predetermined blending order, thereby creating an intermediate blended image, and blending the intermediate blended image with the foremost graphics image layer, to produce an output image having the foremost graphics image layer blended in a foremost position with respect to the other corresponding image layers with negligible loss of information of the other corresponding image layers, wherein the blending module is selectably controllable to blend the intermediate blended image with the foremost graphics image layer in accordance with an alpha blending convention or an AND/XOR blending convention;

wherein the blending module comprises a first mixing module and a second mixing module, wherein the first mixing module is operable to blend at least two of the corresponding image layers to produce the intermediate blended image, and wherein the second mixing module is operable to blend the foremost graphics image layer with the intermediate blended image.

2. The video graphics module of claim 1, wherein the blending module is operable to blend the corresponding image layers in a predetermined blending order using one of: AND/XOR blending and alpha blending.

3. The video graphics module of claim 2, wherein the blending module is operable to blend the corresponding image layers using alpha blending and a specified per pixel alpha value or a global alpha value, wherein the alpha blending is performed using one of a plurality of pixel depths.

4. The video graphics module of claim 2, wherein the blending module is operable to blend the corresponding image layers using AND/XOR blending and one of a plurality of pixel depths.

5. The video graphics module of claim 1, wherein the first mixing module further comprises:

a first input for receiving one of the at least two of the corresponding image layers;

a second input for receiving another one of the at least two of the corresponding image layers;

a blending module operably coupled to blend the at least two of the corresponding image layers based on an alpha calculation using a specified alpha value; and an alpha value calculation module operably coupled to the blending module, wherein the alpha value calculation module generates the specified alpha value based on at least one of: a global alpha value, a per pixel value associated with at least one of the at least two of the corresponding image layers, and a blending mode selection.

6. The video graphics module of claim 1, wherein the second mixing module further comprises:

a first input for receiving the intermediate blended image;

a second input for receiving the foremost graphics image layer; and wherein the blending module is operable to blend the intermediate blended image and the foremost image layer based on a mixing selection to produce the output image.

7. The video graphics module of claim 1, wherein each of the corresponding image layers has a color base of at least one of: an RGB color base and a YUV color base.

8. The video graphics module of claim 7, wherein the one of the plurality of video graphics pipelines that is operable to process the foremost graphics image layer is further operable to produce a first foremost graphics image layer having the RGB color base and a second foremost image layer having the YUV color base.

9. The video graphics module of claim 7, wherein the plurality of video pipelines operable to process the corresponding image layers is further operable to produce the corresponding image layers having the RGB color base, and wherein the blending module further comprises:

an RGB blending module operably coupled to produce the output image having the RGB color base;

an RGB to YUV conversion module operably coupled to convert corresponding image layers to have the YUV color base, and a YUV blending module operably coupled to produce the output image having the YUV color base based at least on the corresponding image layers having the YUV color base.

10. A video graphics module comprises:

a video graphics pipeline module operable to process at least one image layer;

a hardware cursor pipeline operable to process a cursor image;

wherein the at least one image layer and the cursor image are operably received from a frame buffer; and a blending circuit operably coupled to the video graphics pipeline and the hardware cursor pipeline, wherein the blending circuit is operable to blend, in accordance with an alpha blending convention, the at least one image layer and the cursor image, to produce an output image having the cursor image alpha blended in a foremost position with respect to the at least one corresponding image layer;

wherein the blending circuit comprises a first mixing module and a second mixing module, wherein the first mixing module is operable to blend the at least one image layer to produce an intermediate blended image based on a determined alpha blending mode from a plurality of modes, and wherein the second mixing module is operable to blend the cursor image with the intermediate blended image.

11. The video graphics module of claim 10, wherein the blending circuit is operable to blend the at least one image layer and the cursor image using a specified per pixel alpha value or a global alpha value, and further using one of a plurality of pixel depths.

12. The video graphics module of claim 10, wherein the at least one image layer includes a plurality of image layers, wherein the blending circuit is operable to blend the plurality of images layers and the cursor image layer in a predetermined blending order, wherein the predetermined blending order further comprises blending at least two of the plurality of image layers to produce the intermediate blended image, and subsequently blending the cursor image layer with the intermediate blended image.

13. The video graphics module of claim 12, wherein the first mixing module is operable to blend the at least two of the plurality of image layers to produce the intermediate blended image, and wherein the second mixing module is operable to blend the cursor image layer with the intermediate blended image.

14. The video graphics module of claim 13, wherein the first mixing module further comprises:

a first input for receiving one of the at least two of the plurality of image layers;

a second input for receiving another one of the at least two of the plurality of image layers:

a blending module operably coupled to blend the at least two of the plurality of image layers based on an alpha calculation using a specified alpha value; and an alpha value calculation module operably coupled to the blending module, wherein the alpha value calculation module generates the specified alpha valued based on at least one of: a global alpha value, a per pixel value associated with at least one of the at least two of the image layers, and a non-alpha blend mode.

15. The video graphics module of claim 13, wherein the second mixing module further comprises:

a first input for receiving the intermediate blended image;

a second input for receiving the cursor image layer; and a blending module operable to alpha blend the intermediate blended image and the cursor image layer to produce the output image.

16. The video graphics module of claim 10, wherein the blending circuit further comprises:

a first input for receiving the at least one image layer;

a second input for receiving the cursor image layer; and a blending module operable to alpha blend the at least one image layer and the cursor image layer to produce the output image.

17. The video graphics module of claim 10, wherein the at least one image layer and the cursor image each has a color base of at least one of: an RGB color base and a YUV color base.

18. The video graphics module of claim 17, wherein the video graphics pipeline is operable to process the at least one image layer to have the RGB color base, wherein the hardware cursor pipeline is operable to process the cursor image to have the RGB color base, and wherein the blending module further comprises:

an RGB blending module operably coupled to produce the output image having the RGB color base;

an RGB to YUV conversion module operably coupled to convert the at least one image layer and the cursor image to each have the YUV color base, and a YUV blending module operably coupled to produce the output image having the YUV color base from the at least one image layer having the YUV color base and the cursor image having the YUV color base.

19. A video graphics data blending circuit comprises:

a first video graphics pipeline operable to produce a first image layer based on corresponding first image layer data from at least one frame buffer;

a second video graphics pipeline operable to produce a second image layer based on corresponding second image layer data from the at least one frame buffer;

a third video graphics pipeline operable to produce a third graphics image layer based on corresponding graphics image data from the at least one frame buffer;

a first blending module operable to blend the first and second image layers based on an alpha calculation using a specified alpha value to generate an intermediate blended image;

an alpha value calculation module operably coupled to the first blending module, wherein the alpha value calculation module generates the specified alpha value based on a determined alpha blending mode from a plurality of modes wherein the modes correspond to using at least one of: a global alpha value, a per pixel value associated with at least one of the first and second image layers, and a non-alpha blend mode; and a second blending module operable to blend the intermediate blended image with the third graphics image layer using alpha blending to produce an output image such that the graphics image layer has a foremost position in the output image.

20. The video graphics data blending circuit of claim 19, wherein the alpha value calculation module further comprises firmware that, for the non-alpha blend mode, detects a color key in at least one of the first and second image layers to produce a color key result, and generates the specified alpha value as a fully transparent value or a fully opaque value based on the color key result.

21. The video graphics data blending circuit of claim 19, wherein the first blending module further comprises firmware for performing the blending of the first and second image layers using a premultiplied alpha blending process or a non-premultiplied alpha blending process.

22. The video graphics data blending circuit of claim 19 further comprises a first multiplexor operably coupled to the first input and a second multiplexor operably coupled to the second input, wherein the first multiplexor is operably coupled to receive a plurality of image layers and to output the first image layer and the second multiplexor is operably coupled to receive the plurality of image layers and output the second image layer.

23. The video graphics data blending circuit of claim 22, wherein the alpha value calculation module further comprises firmware that provides control information to the first and second multiplexors such that the first multiplexor outputs the first image layer and the second multiplexor outputs the second image layer.

24. An apparatus for determining an alpha calculation mode, the apparatus comprises:

a blending module operative to:

receive a first image layer from a first video graphics pipeline wherein the first image layer is based on corresponding first image layer data from at lease one frame buffer;

receive a second image layer in parallel with the first image layer from a second video graphics pipeline wherein the second image layer is based on corresponding second image layer data from the at least one frame buffer; and receive a graphics image layer from a third video graphics pipeline wherein the graphics image layer is based on corresponding graphics image data from the at least one frame buffer;

a processing module;

memory operably coupled to the processing module, wherein the memory stores operational instructions that cause the processing module to (a) determine an alpha blending mode from a plurality of modes, wherein each of the plurality of modes corresponds to at least one of utilizing a per pixel alpha blending value, utilizing a global alpha blending value, and utilizing a key alpha blending value; (b) obtain blending information based on the alpha blending mode; (c) generate a corresponding blending value based on the blending information; and (d) provide the corresponding blending value to the blending module;

wherein the blending module is further operable to blend the first and second image layers based on an alpha calculation using the corresponding alpha value to generate an intermediate blended image; and wherein the blending module is further operable to blend the intermediate blended image with the graphics image layer using alpha blending to produce an output image such that the graphics image layer has a foremost position in the output image.

25. The apparatus of claim 24, wherein the memory further comprises operational instructions that cause the processing module to, when the alpha blending mode indicates using the global alpha blending value, retrieve at least one global alpha value from a general alpha register.

26. The apparatus of claim 24, wherein the memory further comprises operational instructions that cause the processing module to, when the alpha blending mode indicates using the per pixel alpha blending value, retrieve at least one corresponding per pixel alpha blending value from an image layer input.

27. The apparatus of claim 24, wherein the memory further comprises operational instructions that cause the processing module to, when the alpha blending mode indicates using the key alpha blending value, retrieve an alpha key indication from a keyer, wherein the keyer generates the alpha key indication from at least one corresponding per pixel alpha value associated with an image layer input.

* * * * *